US006123512A

United States Patent [19]

Benner et al.

[11] Patent Number: 6,123,512

[45] Date of Patent: Sep. 26, 2000

[54] HEAT DRIVEN PULSE PUMP

[75] Inventors: Steve M Benner, Columbia; Mario S. Martins, Annapolis, both of Md.

[73] Assignee: The United States of America as represented by the Administrator of the National Aeronautics and Space Administration, Washington, D.C.

[21] Appl. No.: 09/131,372

[22] Filed: Aug. 7, 1998

Related U.S. Application Data

[60] Provisional application No. 60/055,038, Aug. 8, 1997.

[51] Int. Cl.[7] ..... F04B 19/24

[52] U.S. Cl. ..... 417/209

[58] Field of Search ..... 417/207, 208, 417/209

[56] References Cited

U.S. PATENT DOCUMENTS

| | | | |
|---|---|---|---|
| 3,898,017 | 8/1975 | Mandroian | 417/65 |
| 4,004,441 | 1/1977 | Leszak | 72/75 |
| 4,451,210 | 5/1984 | Shaubach et al. | 417/209 |
| 4,470,759 | 9/1984 | Kosson | 417/208 |
| 4,556,368 | 12/1985 | Jean et al. | 417/208 |
| 4,640,667 | 2/1987 | Trepp | 417/207 |
| 4,765,396 | 8/1988 | Seidenberg | 165/104.26 |
| 4,792,283 | 12/1988 | Okayasu | 417/52 |
| 4,954,048 | 9/1990 | Ohrt | 417/209 |
| 5,725,049 | 3/1998 | Swanson et al. | 165/104.26 |

FOREIGN PATENT DOCUMENTS

| | | | |
|---|---|---|---|
| 892031 | 12/1981 | U.S.S.R. | 417/209 |
| 794781 | 5/1958 | United Kingdom | 417/209 |

OTHER PUBLICATIONS

Design, Development and Test of Capillary Pump Loop Heat Pipe; by E. J. Kroliczeck, et al.; AIAA 19th Thermophysics Conference; Snowmass, Colorado; Jun. 25–28, 1984.

*Primary Examiner*—Erick Solis

[57] ABSTRACT

A heat driven pulse pump includes a chamber having an inlet port, an outlet port, two check valves, a wick, and a heater. The chamber may include a plurality of grooves inside wall of the chamber. When heated within the chamber, a liquid to be pumped vaporizes and creates pressure head that expels the liquid through the outlet port. As liquid separating means, the wick, disposed within the chamber, is to allow, when saturated with the liquid, the passage of only liquid being forced by the pressure head in the chamber, preventing the vapor from exiting from the chamber through the outlet port. A plurality of grooves along the inside surface wall of the chamber can sustain the liquid, which is amount enough to produce vapor for the pressure head in the chamber. With only two simple moving parts, two check valves, the heat driven pulse pump can effectively function over the long lifetimes without maintenance or replacement. For continuous flow of the liquid to be pumped a plurality of pumps may be connected in parallel.

23 Claims, 6 Drawing Sheets

HEAT DRIVEN PULSE PUMP

CROSS-REFERENCE TO RELATED APPLICATIONS

This application now formalizes and incorporates herein by reference Provisional Application Serial No. 60/055,038, "Heat Driven Pulse Pump (HDPP)," Steve Benner, et al., filed on Aug. 8, 1997. Applicant claims the priority date thereof under 35 U.S.C. 119(e).

ORIGIN OF THE INVENTION

The invention described herein was jointly made by an employee of the United States Government and a non-employee of the United States Government. The invention may be manufactured and used by or for the Government purpose without the payment of royalties thereon or therefor.

FIELD OF THE INVENTION

The present invention relates to an apparatus for pumping. More particularly, the present invention relates to a heat driven pump which performs pumping by repetitively heating the liquid to be pumped.

BACKGROUND OF THE INVENTION

Currently, single and two-phase thermal control system used in spacecraft require a mechanical pump to produce the pressure head needed to overcome the loop pressure drop and circulate the working fluid. As power density and operational longevity of spacecraft continue to increase, it is important that spacecraft use a highly reliable and efficient fluid thermal control system. To meet the demand for low-flow thermal control systems, a number of pumps have been adapted from terrestrial application, especially vane and gear pumps. Unfortunately, mechanical pumps have numerous moving parts that can wear out or break. There are moving parts in both the motor and the pump head. In addition, they also require elaborate electronic control circuits that generate heat and are subject to failure. For short duration mission, such as Shuttle flight, this type of mechanical pumps are adequate. However, if a spacecraft is to operate in a microgravity gravity environment for five years without maintenance, then the pump has to be reliable enough to last about 50,000 hours.

Operation of the heat driven pump relies on pressure of vapor in a closed chamber. More specifically heating a liquid contained in a chamber produces a vapor that can be used for pumping function.

Many types of heat driven pumps have been developed in this field. One device includes a chamber which contains a pumping gas to be expanded by heating. A liquid to be pumped is introduced into the chamber through ingress means. Expansion of the gas in response to heating the chamber causes the liquid to exit through egress means. Since there is no means of separating the pumped liquid from the pumping gas, the gas can exit the chamber, reducing performance of the pump.

Another device provides a vapor pressure pump comprising a closed reservoir for liquid, an inlet check valve, an outlet check valve, heating means, and a vapor exhaust valve and a float, both of which are adapted to balance the pressure between the check valves. A liquid introduced into the reservoir moves up the float to close the vapor exhaust valve disposed at top of the reservoir. Vapor generated by heating the reservoir forces the liquid out through the outlet check valve. This device also lacks means for separating the vapor from the liquid to be pumped. In addition, operation of this device relies on a the float, which is a moving part and may become subject to mechanical failure.

Yet another device uses inlet and outlet porous membranes for separating a liquid to be pumped from a pumping vapor. The liquid enters the chamber due to liquid permeability of the inlet porous membrane. Bubbles generated by heating the liquid in the chamber force the liquid to exit through the outlet porous membrane. Since introduction of the liquid relies on capillary effect of the porous membranes, refilling of the pumping chamber would be slow and can result in back flow of the liquid.

A further device provides a heat-driven pump for performing the transport of a liquid by the function of bubbles generated by vaporization and condensation of the liquid under heating. The liquid to be heated for the pumping is in contact with the rest of the liquid in the pumping chamber. Therefore, it would result in heating all the liquid in a pumping chamber to produce bubbles for pumping, lowering efficiency of the pump.

A still further device provides a capillary pumped loop, which comprises a capillary evaporator for vaporizing a liquid refrigerant by absorbing heat, a condenser for turning a vaporized refrigerant into a liquid by transferring heat from the vaporized liquid to a cool object. A wick and a plurality of grooves, both of which are adopted to the present invention, are utilized for pumping.

SUMMARY OF THE INVENTION

The pump of the present invention comprises a chamber having an inlet port and an outlet port for the liquid to be pumped therethrough. Operatively connected to the inlet port and the outlet port are an inlet check valve and an outlet check valve, respectively, both of which open in response to increase in pressure and allow flow of the liquid only in one direction. For example, the inlet check valve opens in response to higher pressure in the liquid to be pumped into the chamber than the pressure within the chamber. Similarly, the outlet check valve opens in response to higher pressure within the chamber than the pressure in a point to which the liquid is to be expelled.

Disposed outside of the chamber is a heater used as heating means, which is repetitively activated so that the liquid heats up, vaporizes, and creates a pressure head, which exceeds pressure drop in the chamber and expels the liquid to be pumped through the outlet port. Separate means are provided to activate the heating means in a predetermined manner.

A wick, being used as liquid separating means and disposed within the chamber, allows the passage of liquid being forced by the pressure head in the chamber when saturated with the liquid. The wick fluidly isolate the inlet port from the outlet port so that the liquid being expelled through the outlet port is only forced through the wick.

The process of pumping the liquid by the present invention is as follows: 1) Admitting the liquid to be pumped into the chamber through the inlet check valve, which opens in response to higher pressure in a source of the liquid than the pressure within the chamber; 2) Heating the liquid in the chamber to evaporate to create a pressure head exceeding pressure within the chamber; 3) Passing the liquid, being forced by the pressure head within the chamber, through the wick and to the outlet port; 4) Expelling the liquid through the out check valve, which opens in response to higher pressure within the chamber than that in a point of use of the liquid; 5) Terminating heating the chamber; and 6) Allowing the chamber to cool and then produce a drop in pressure within the chamber, which subsequently admits the liquid through the inlet check valve and repeats the next pumping cycle.

In a first alternate embodiment of the present invention, the chamber is having a plurality of grooves along the inside surface wall thereof. Once entering the chamber, the liquid will fill up the grooves, which are to disperse and sustain the liquid through the inside surface wall of the chamber. Heating the liquid sustained in the grooves will provide vapor pressure enough to push the liquid in the chamber through the liquid separating means without heating all the liquid in the chamber, thereby increasing the efficiency of the pump.

Grooves within the chamber provide advantages over other heat driven pumping devices. For example, the lands between grooves contribute to an increase thermal efficiency as the mushroom shape of the lands results in a greater surface area being exposed to the liquid to be evaporated. Another advantage is that since the grooves can sustain the liquid to be evaporated the pump can continuously function in a microgravity environment, where due to absence of gravity the liquid may float inside the chamber without making thermal contact with the inside wall. A further advantage is that the liquid sustained in the grooves will be able to produce enough vapor to push out the liquid to be pumped, eliminating the need to heat up all the liquid in chamber In a second alternate embodiment of the present invention, the grooves may be replaced with a mesh, which covers inside wall of the chamber.

In a third alternate embodiment of the present invention, a strap may be installed in the chamber such that the admitted liquid will be uniformly dispersed into said grooves. Thus, The liquid admitted through the inlet port will feed into the grooves and then spill over to fill the chamber. The liquid uniformly dispersed into the grooves through the strap will be able to generate enough vapor pressure to push the liquid through the liquid separating means and to the outlet port.

In a fourth alternate embodiment of the present invention, a wick is having a cavity aligned with the inlet port and is disposed along perimeter of the inside wall of the chamber. In this configuration, the liquid admitted through the inlet port is uniformly dispersed around the cavity and feeds into the grooves.

In a fifth alternate embodiment of the present invention, a plurality of pumps are connected in parallel to provide continuous flow of the pumped liquid. With a predetermined sequence for activating each pump, continuous flow of the pumped liquid can be accomplished.

It is necessary to keep the temperature of the pump below the saturation temperature of the pumped liquid. This will allow the vapor inside the pump to condense as soon as the heating of the chamber stops. To this end, it may be desirable to attach a chilling block as temperature maintaining means to outside of the pump.

Accordingly, it is an object of the present invention to provide a heat driven pulse pump with higher efficiency and longer life.

It is yet another object of the present invention to provide a heat driven pulse pump, which is suitable for operation in a microgravity environment It is a further object of the present invention to provide a method of utilizing a plurality of the heat driven pulse pumps in parallel for continuous flow of the liquid to be pumped.

DESCRIPTION OF DRAWINGS

FIG. 3-*a* is a partial sectional view of grooves, as shown in FIG. 3.

DETAILED DESCRIPTION

Figure 1:
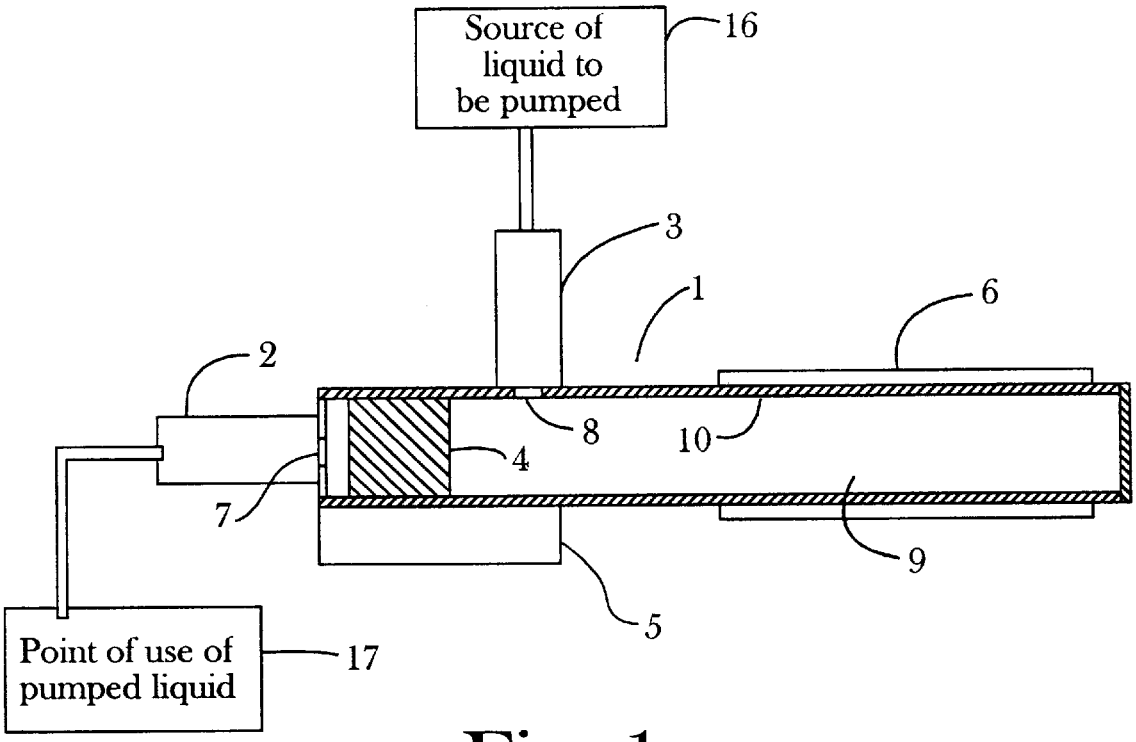
FIG. 1 is a longitudinal crosssectional view of the heat driven pulse pump of the present invention.

Referring to the drawings, a number of embodiments of the present invention will be described hereinafter.

FIG. 1 illustrates a heat driven pulse pump 1 of the present invention. Pump 1 comprises a chamber 9, an inlet port 8 and an inlet check valve 3, an outlet port 7 and an outlet check valve 2, a heater 6 as heating means, and a wick 4 as liquid separating means.

A liquid (not shown) supplied from a source of the liquid 16 is admitted into chamber 9 through inlet check valve 3, which opens in response to higher pressure. This high pressure results from a build up of vapor pressure within chamber 9. Since outlet port 7 and inlet port 8 are fluidly isolated by wick 4, the liquid remains in chamber 9 upon the admission.

As heater 6 is activated, the liquid heats up, vaporizes, and creates a pressure head exceeding the pressure within chamber 9. The liquid may also be heated by introducing waste heat to chamber 9. This waste heat is typically generated as a by-product of the operation of electronic instruments that must be cooled.

The pressure head generated through heating the liquid pushes the liquid in chamber 9 through wick 4 and out past outlet check valve 2, which opens in response to the higher pressure within chamber 9. Wick 4 as liquid separating means is an uniformly porous, permeable, and open-cell foam. Wick 4 prevents the vapor (not shown) from exiting from chamber 9 through outlet port 7 to a point of use of the pumped liquid 17 thereby improving the efficiency of pump 1.

As heat is removed from chamber 9 due to the deactivation of heating means 6, the vapor begins to condense, causing the pressure to drop within chamber 9. In response to low pressure within chamber 9, inlet check valve 3 opens, introducing a new liquid to pump 1 and then starting a new pumping cycle.

Figure 2:
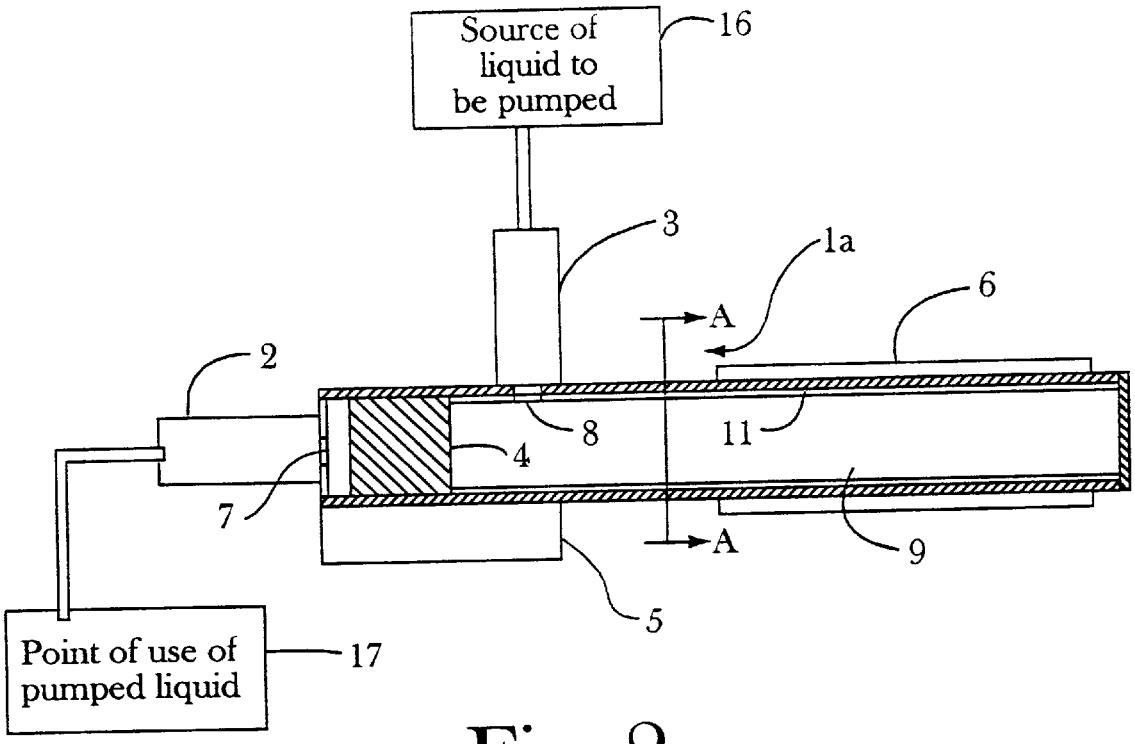
FIG. 2 is a longitudinal crosssectional view of a first alternate embodiment of the heat driven pulse pump of the present invention.
Figure 3:
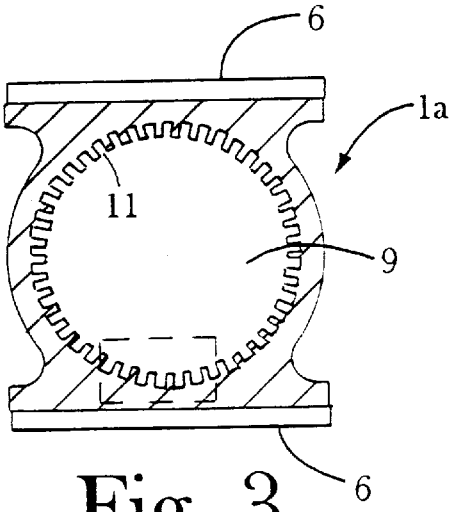
FIG. 3 is a crosssectional view of the heat driven pulse pump taken along line A—A of FIG. 2.
Figure 3A:
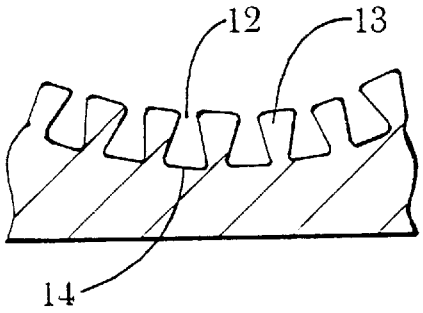

Referring now to FIG. 2, wherein pump 1*a* includes a plurality of grooves 11 along the inside surface wall of chamber 9, a liquid is introduced through inlet port 8 thereby filling grooves 11. Referring now to FIG. 3-*a*, opening 12 is smaller than width of the base of groove 14. This arrangement allows grooves to sustain the liquid, both top and bottom of the chamber 9.

FIG. 3 depicts cross section of the heat driven pulse pump of FIG. 2 having a plurality of grooves 11 within chamber 9.

Figure 4:
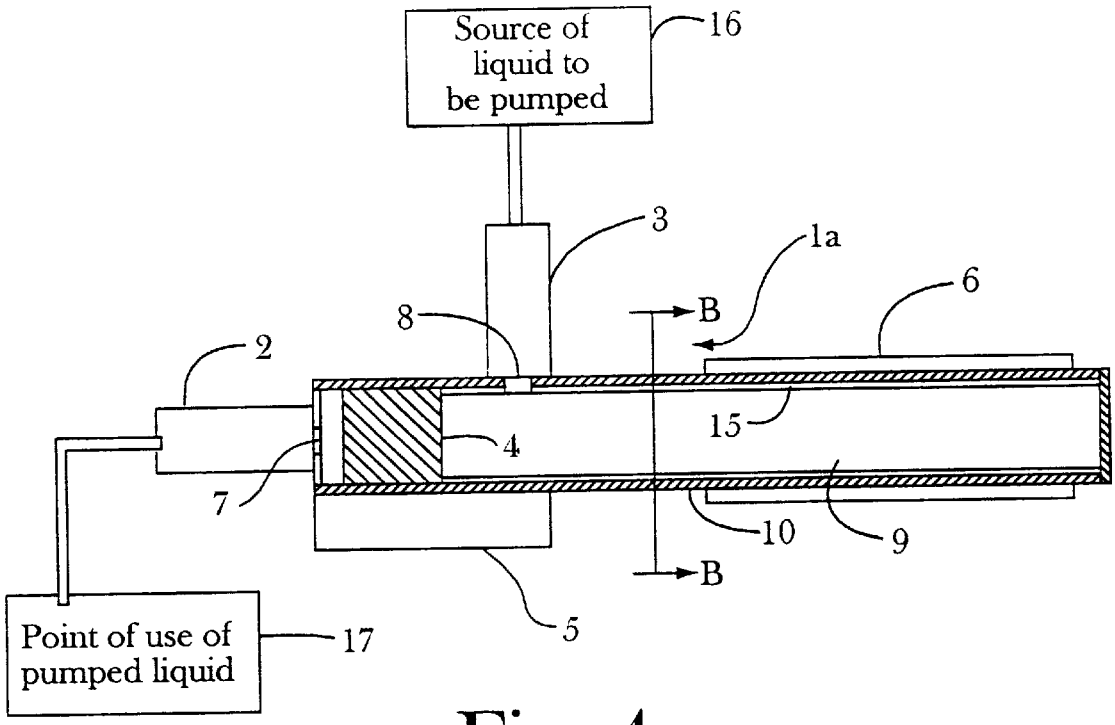
FIG. 4 is a longitudinal crosssectional view of a second alternate embodiment of the heat driven pulse pump of the present invention.
Figure 5:
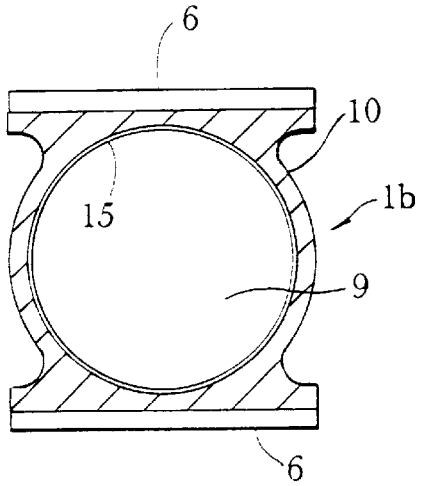
FIG. 5 is a crosssectional view of the heat driven pulse pump of pump taken along line B—B of FIG. 4.

Grooves 11 may be replace with a mesh 15 covering the inside surface wall 10 of chamber 9 for the purpose of sustaining the liquid to be evaporated, as shown in FIG. 4 and FIG. 5.

Figure 6:
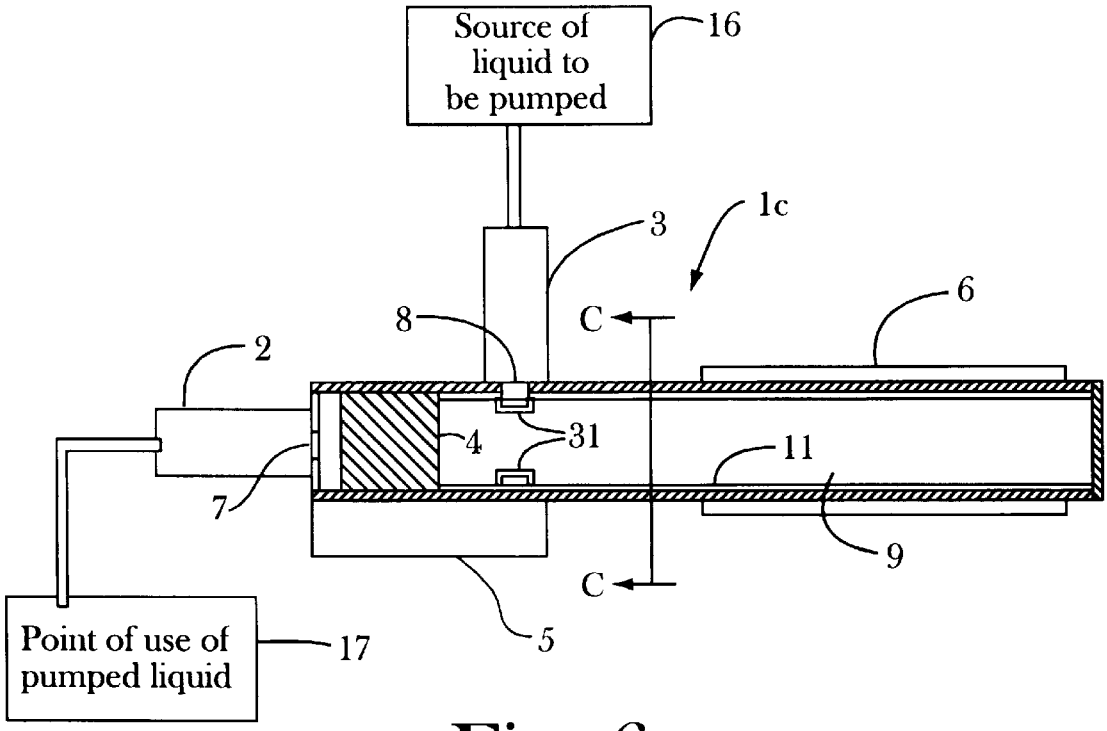
FIG. 6 is a longitudinal crosssectional view of a third alternate embodiment of the heat driven pulse pump of the present invention.

Referring to FIG. 6, a strap 31 is disposed within chamber 9 such that liquid admitted through inlet port 8 uniformly disperses into grooves 11. The liquid entering through inlet port 8 fills up grooves 11 first and then spills over chamber 9.

Figure 7:
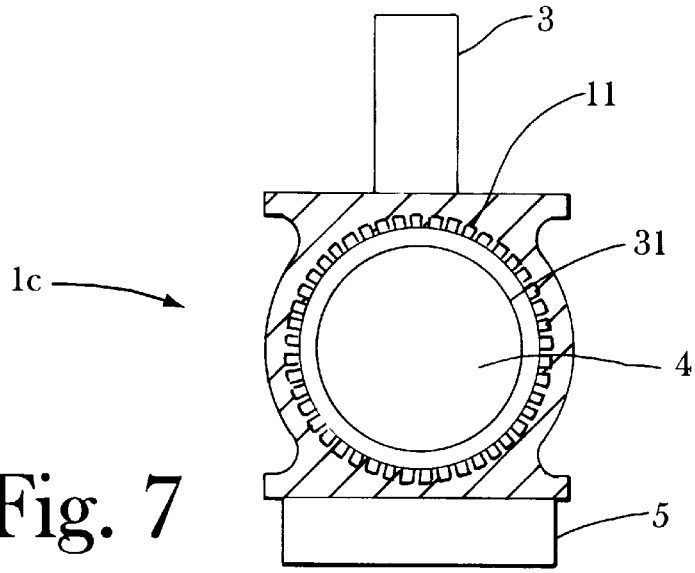
FIG. 7 is a crosssectional view of the heat driven pulse pump taken along line C—C of FIG. 6.

FIG. 7 shows a crosssectional view of FIG. 6. having a strap 31 within chamber 9.

Figure 8:
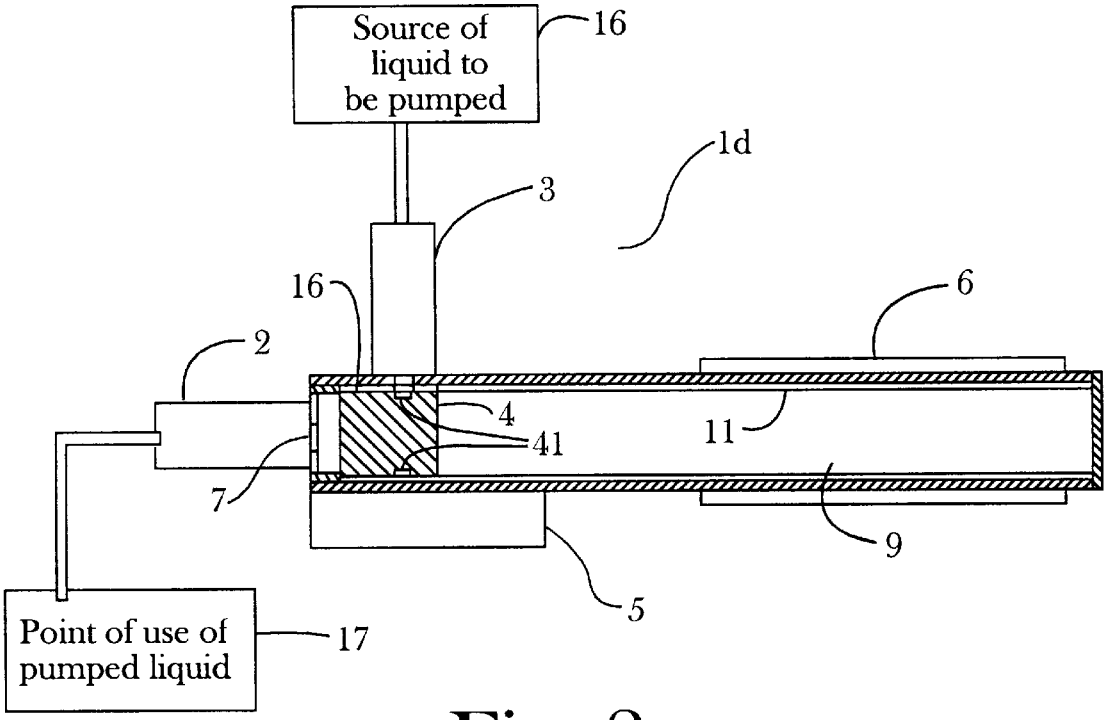
FIG. 8 is a longitudinal crosssectional view of a fourth alternate embodiment of the heat driven pulse pump of the present invention.

Referring now to FIG. 8, wick 4 in heat driven pulse pump 1*d* further includes a cavity 41 disposed along perimeter 16 of inside wall 10 of chamber 9. Also inlet port 8 is aligned with cavity 41 so that liquid admitted through inlet port 8 is uniformly dispersed around cavity 41 and feeds into grooves 11. When the liquid is admitted through inlet port 8, the higher resistance of wick 4 forces the liquid to enter grooves 11 first and then spill over to fill chamber 9.

In order for heat drive pulse pump of the present invention to repeat pumping cycle, it is necessary to provide a chilling block 5 as temperature maintaining means to keep temperature of the pump below saturation temperature of the pumped liquid. After vapor produced by the heating process pushes the liquid through wick 4 to outlet port 7 and heater 6 is deactivated, the pressure within chamber 9 must be decrease so that inlet check valve 3 opens to allow the liquid to be pumped in to chamber 9 for the next pumping cycle. Decreasing pressure within chamber 9 can be accomplished by lowering the temperature of the pump Normally when the temperature differential between the temperature of a structure on which the pump is mounted and the temperature of the pump is less than about 5 degree C. it is necessary to provide chilling block 5 attached to outside of the pump.

Figure 9:
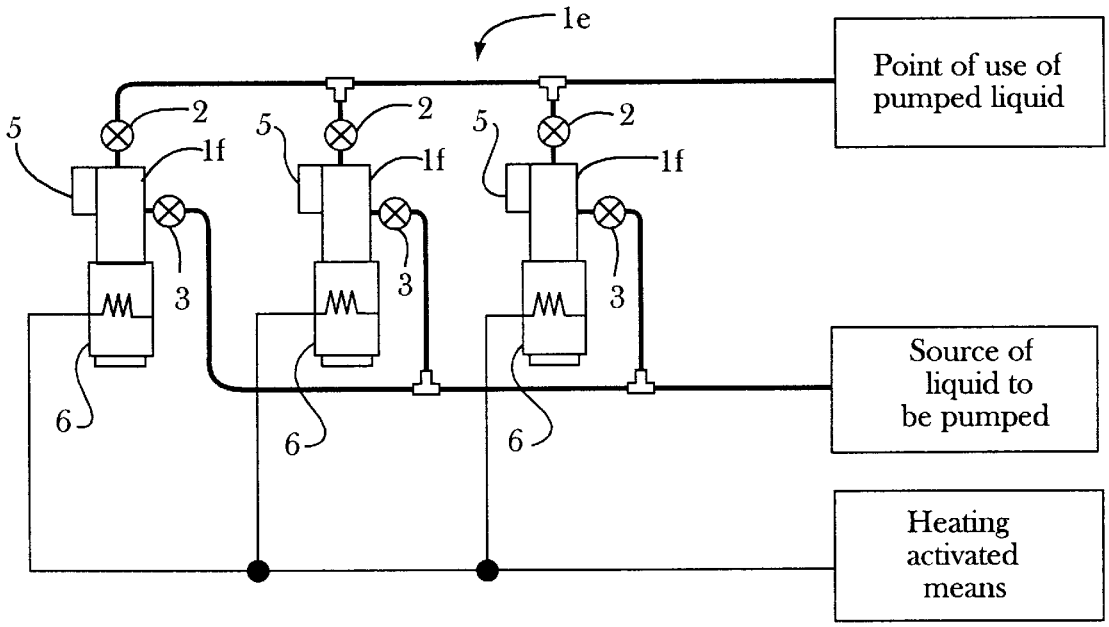
FIG. 9 illustrates an overall view of a fifth alternate embodiment of the heat driven pulse pump of the present invention.

A plurality of pumps 1*e* may be connected in parallel to provide continuous flow of the pumped liquid. FIG. 9 illustrates a configuration of three pumps 1*f*. Since each pump 1*f* needs recovery time to cool down before starting the next pumping cycle, the sequence of activation of each pump must be established so that continuous flow of the liquid is maintained. For example, when one pump has liquid vaporizing, another is heating up, and the third is filling.

What is claimed is:

1. A heat driven pulse pump for pumping a liquid therethrough comprising:

a chamber having an inlet port and an outlet port;

means disposed outside of said chamber for repetitively heating said liquid flowing through said chamber;

an inlet check valve operatively connected to said inlet port for allowing said liquid to enter said chamber;

an outlet check valve operatively connected to said outlet port for allowing said liquid to exit therethrough; and liquid separating means for separating said liquid from vapor within said chamber by allowing the passage of said liquid to said outlet port upon an increase in pressure in said chamber, said liquid separating means fluidly isolating said inlet port from said outlet port so that the liquid being expelled through said outlet port is only forced through said liquid separating means.

2. A heat driven pulse pump for pumping a liquid therethrough comprising:

a chamber having an inlet port, an outlet port, and a plurality of grooves disposed along the inside surface wall thereof;

means disposed outside of said chamber for repetitively heating said liquid flowing through said chamber;

an inlet check valve operatively connected to said inlet port for allowing said liquid to enter said chamber;

an outlet check valve operatively connected to said outlet port for allowing said liquid to exit therethrough; and liquid separating means for separating said liquid from vapor within said chamber by allowing the passage of said liquid to said outlet port upon an increase in pressure in said chamber.

3. A heat driven pulse pump for pumping a liquid therethrough comprising:

a chamber having an inlet port, an outlet port, and a mesh attached to the inside surface wall thereof;

means disposed outside of said chamber for repetitively heating said liquid flowing through said chamber;

an inlet check valve operatively connected to said inlet port for allowing said liquid to enter said chamber;

an outlet check valve operatively connected to said outlet port for allowing said liquid to exit therethrough; and liquid separating means for separating said liquid from vapor within said chamber by allowing the passage of said liquid to said outlet port upon an increase in pressure in said chamber.

4. A heat driven pulse pump for pumping a liquid therethrough comprising:

a chamber having an inlet port and an outlet port;

means disposed outside of said chamber for repetitively heating said liquid flowing through said chamber;

an inlet check valve operatively connected to said inlet port for allowing said liquid to enter said chamber;

an outlet check valve operatively connected to said outlet port for allowing said liquid to exit therethrough;

liquid separating means for separating said liquid from vapor within said chamber by allowing the passage of said liquid to said outlet port upon an increase in pressure in said chamber; and means for activating said heating means in a predetermined manner.

5. A heat driven pulse pump for pumping a liquid therethrough comprising:

a plurality of chambers wherein each chamber includes a inlet port and an outlet port with means for repetitively heating the liquid flowing through said chamber;

an inlet check valve operatively connected to said inlet port for allowing said liquid to enter said chamber;

an outlet check valve operatively connected to said outlet port for allowing said liquid to exit therethrough; and liquid separating means for separating said liquid from vapor within said chamber by allowing the passage of said liquid to said outlet port upon an increase in pressure in said chamber;

means for alternatively activating each of said heating means in a predetermined manner;

said inlet check valves being connected in parallel and to a source of said liquid to be pumped, and said outlet checks valves being connected in parallel and to a point of use of said pumped liquid.

6. The heat driven pulse pump of claim 2 further comprising a strap to uniformly disperse said liquid into said grooves.

7. The heat driven pulse pump of claim 3 further comprising a strap to uniformly disperse said liquid into said mesh.

8. The heat driven pulse pump of claim 2 wherein said liquid separating means include a cavity to uniformly disperse said liquid into said grooves.

9. The heat driven pulse pump of claim 3 wherein said liquid separating means include a cavity to uniformly disperse said liquid into said mesh.

10. The heat driven pulse pump of claim 2 wherein said liquid separating means is a wick.

11. The heat driven pump of claim 1, further comprising:

means for maintaining the temperature of said pump below the saturation temperature of said liquid.

12. The heat driven pulse pump of claim 11 wherein each of said chambers has a plurality of grooves disposed along the inside surface wall of said chamber.

13. The heat drive pulse pump of claim 11, each of said chambers further comprising a mesh attached to the inside surface wall of said chamber.

14. The heat driven pulse pump of claim 12, each of said chambers further comprising a strap to uniformly disperse said liquid into said grooves.

15. The heat driven pulse pump of claim 13, each of said chambers further comprising a strap to uniformly disperse said liquid into said mesh.

16. The heat driven pulse pump of claim 12 wherein each of said liquid separating means includes a cavity to uniformly disperse said liquid into said grooves.

17. The heat driven pulse pump of claim 13 wherein each of said liquid separating means includes a cavity to uniformly disperse said liquid into said mesh.

18. The heat driven pulse pump of claim 11 wherein each of said liquid separating means is a wick.

19. The heat driven pump as one of claims 11–18, further comprising:

means attached to outside of each of said chambers for maintaining the temperature of said pump below the saturation temperature of said liquid.

20. The heat driven pump of claim 2 further comprising means for activating said heating means in a predetermined manner.

21. The heat driven pump of claim 3 further comprising means for activating said heating means in predetermined manner.

22. The heat driven pulse pump of claim 3 wherein said liquid separating means is a wick.

23. The heat driven heat pulse pump as in one of claims 2–8 or 20–22, further comprising:

means for maintaining the temperature of said pump below the saturation temperature of said liquid.

* * * * *